US008740719B2

(12) United States Patent
Wahl et al.

(10) Patent No.: US 8,740,719 B2
(45) **Date of Patent: *Jun. 3, 2014**

(54) GOLF CLUB HEAD

(71) Applicant: Taylor Made Golf Company, Inc., Carlsbad, CA (US)

(72) Inventors: Bret H. Wahl, Escondido, CA (US); Chris Schartiger, San Diego, CA (US); Marni D. Ines, San Marcos, CA (US); Peter L. Larsen, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/855,591

(22) Filed: Apr. 2, 2013

(65) Prior Publication Data

US 2013/0231202 A1 Sep. 5, 2013

Related U.S. Application Data

(63) Continuation of application No. 13/448,263, filed on Apr. 16, 2012, now Pat. No. 8,409,028, which is a continuation of application No. 12/764,707, filed on Apr. 21, 2010, now Pat. No. 8,157,668, which is a continuation-in-part of application No. 12/538,071, filed on Aug. 7, 2009, now Pat. No. 8,033,931.

(51) Int. Cl.
*A63B 53/00* (2006.01)
*A63B 53/04* (2006.01)

(52) U.S. Cl.
USPC ..... 473/288; 473/331; 473/342; 473/350

(58) Field of Classification Search
CPC ..... A63B 53/047; A63B 2053/0416; A63B 53/06; A63B 53/0475
USPC ..... 473/324–350, 287–292
See application file for complete search history.

(56) References Cited

U.S. PATENT DOCUMENTS

| | | | |
|---|---|---|---|
| 1,094,599 | A | 4/1914 | Samson |
| 1,253,700 | A | 1/1918 | McLaughlin |
| 1,289,553 | A | 12/1918 | Sanders |
| 3,333,854 | A | 8/1967 | White |

(Continued)

FOREIGN PATENT DOCUMENTS

JP 06-165843 6/1994

OTHER PUBLICATIONS

Office action from the U.S. Patent and Trademark Office in U.S. Appl. No. 12/006,060, dated Nov. 26, 2010.

(Continued)

*Primary Examiner* — Sebastiano Passaniti
(74) *Attorney, Agent, or Firm* — Klarquist Sparkman, LLP

(57) ABSTRACT

An iron-type golf club head is disclosed including a main body including a heel portion, a sole portion, a toe portion, a top-line portion, a front portion, a rear portion, and a striking face. The main body has a recessed region including a relief region in the front portion. A replaceable striking plate is inserted into the recessed region and the relief region. The replaceable striking plate includes a front surface, a first rear surface region and a second rear surface region. A threaded opening is located on the rear surface of the replaceable striking plate and receives a fastener to retain the replaceable striking plate on the front portion of the main body and within the recessed region and relief region.

18 Claims, 13 Drawing Sheets

(56) References Cited

U.S. PATENT DOCUMENTS

| | | | |
|---|---|---|---|
| 3,368,812 | A | 2/1968 | Baldwin |
| 4,252,262 | A | 2/1981 | Igarashi |
| 4,422,638 | A | 12/1983 | Tucker |
| 4,573,685 | A | 3/1986 | Young, IV et al. |
| 4,618,149 | A | 10/1986 | Maxel |
| 4,792,140 | A | 12/1988 | Yamaguchi et al. |
| 4,832,344 | A | 5/1989 | Werner |
| 4,884,808 | A | 12/1989 | Retzer |
| 5,141,231 | A | 8/1992 | Cox |
| 5,303,922 | A | 4/1994 | Lo |
| 5,346,213 | A | 9/1994 | Yamada |
| 5,362,047 | A | 11/1994 | Shaw et al. |
| 5,407,196 | A | 4/1995 | Busnardo |
| 5,407,202 | A | 4/1995 | Igarashi |
| 5,437,447 | A | 8/1995 | Rigutto |
| 5,447,311 | A | 9/1995 | Viollaz et al. |
| 5,509,660 | A | 4/1996 | Elmer |
| 5,595,547 | A | 1/1997 | Lekavich |
| 5,718,644 | A | 2/1998 | Donofrio |
| 5,718,645 | A | 2/1998 | Chang |
| 5,804,272 | A | 9/1998 | Schrader |
| D399,276 | S | 10/1998 | Hettinger et al. |
| 5,816,936 | A | 10/1998 | Aizawa et al. |
| 5,827,131 | A | 10/1998 | Mahaffey et al. |
| 5,921,871 | A | 7/1999 | Fisher |
| 6,224,496 | B1 | 5/2001 | Rowland et al. |
| 6,688,989 | B2 | 2/2004 | Best |
| 6,743,117 | B2 | 6/2004 | Gilbert |
| 7,070,513 | B2 | 7/2006 | Takeda et al. |
| 7,121,958 | B2 | 10/2006 | Cheng et al. |
| 7,258,628 | B2 | 8/2007 | Huang et al. |
| 7,448,961 | B2 | 11/2008 | Lin |
| 7,544,136 | B2 | 6/2009 | Tsai |
| 7,604,550 | B1 | 10/2009 | Currie |
| 8,033,931 | B2 | 10/2011 | Wahl et al. |
| 8,157,668 | B2 | 4/2012 | Wahl et al. |
| 8,409,028 | B2 | 4/2013 | Wahl et al. |
| 2003/0054901 | A1 | 3/2003 | Sun |
| 2004/0009829 | A1 | 1/2004 | Kapilow |
| 2004/0266548 | A1 | 12/2004 | Cheng et al. |
| 2005/0130757 | A1 | 6/2005 | Tucker |
| 2006/0199661 | A1 | 9/2006 | Deng et al. |
| 2006/0252576 | A1 | 11/2006 | Lo |
| 2008/0004131 | A1 | 1/2008 | Lin et al. |
| 2011/0034270 | A1 | 2/2011 | Wahl et al. |
| 2011/0034271 | A1 | 2/2011 | Wahl et al. |

OTHER PUBLICATIONS

Office action from the U.S. Patent and Trademark Office in U.S. Appl. No. 12/764,707, dated Jul. 6, 2011.

Office action from the U.S. Patent and Trademark Office in U.S. Appl. No. 13/448,263, dated Jul. 3, 2012.

GOLF CLUB HEAD

CROSS-REFERENCE TO RELATED APPLICATION

This application is a continuation of U.S. patent application Ser. No. 13/448,263, filed Apr. 16, 2012, which is a continuation of U.S. patent application Ser. No. 12/764,707, filed Apr. 21, 2010, now U.S. Pat. No. 8,157,668, which is a continuation-in-part of U.S. patent application Ser. No. 12/538,071, filed Aug. 7, 2009, now U.S. Pat. No. 8,033,931, all of which are incorporated herein by reference.

FIELD

The present disclosure relates to a golf club head. More specifically, the present disclosure relates to a golf club head with a replaceable face.

BACKGROUND

In general, a golf club head is formed of a metal material with a hosel and sole portion. The golf club head is subject to many different forces and conditions of use which may cause an undesirable feel at impact with a golf ball.

When a golfer approaches a green, it is critical that the golfer can associate a certain feel with a corresponding distance that the ball is likely to travel. An iron has a flat face that normally contacts the ball whenever the ball is being hit with the iron. Irons have angled faces for achieving lofts that are more suitable for certain shots.

Every club has a desired hitting zone on the face for maximizing the probability of the golfer achieving the best and most predictable shot using the particular club. Most golfers strive to make contact with the ball inside the sweet spot to achieve a desired trajectory. However, a golf club head may have a tendency to cause an undesirable feel if the ball is mis-hit in an undesirable location.

A U.S. Pat. No. 5,346,213 to Yamada proposes a golf club head in which a face plate and a head body are different in material from each other to prevent accidental separation of the face plate from the head body. In addition, Yamada describes the undesirable feel associated with the metal face plate and seeks to solve the poor feel qualities with a synthetic resin face.

In addition, over a prolonged period of use, a golf club head score line may wear away from constant use. When the lack of score lines begin to impact the golfer's quality of play, the golfer must go and purchase an entirely new golf club head.

SUMMARY OF THE DESCRIPTION

The present disclosure describes a golf club head comprising a main body and a replaceable face.

The foregoing and other objects, features, and advantages of the invention will become more apparent from the following detailed description, which proceeds with reference to the accompanying figures.

According to one aspect of an embodiment of the present invention, a main body is described including a heel portion, a sole portion, a toe portion, a top-line portion, a front portion, a rear portion, and a striking face. The main body includes a recessed region having a relief region in the front portion. A replaceable striking plate is configured to be inserted into the recessed region and the relief region. The replaceable striking plate includes a front surface and a rear surface.

At least one threaded opening is located on the rear surface of the replaceable striking plate and at least one through-hole opening is located in the rear portion of the main body. The through-hole opening is configured to receive a fastener in the rear portion. The fastener is configured to engage the threaded opening located on the rear surface of the replaceable striking plate to retain the replaceable striking plate on the front portion of the main body and within the recessed region and relief region.

According to one example, two threaded openings are provided and the relief region is located around a 360° perimeter of the back support surface within a plane parallel to the face plane. The threaded openings are a part of a threaded boss. Two threaded bosses may be provided.

According to another example, the recessed region edge substantially forms an O-shape. According to yet another example, the threaded boss is configured to be inserted within a counter bore located in the recessed region.

In one example, a washer is engaged with the fastener. The washer is located within a counter bore of the main body and is engaged with a top surface of the at least one threaded boss.

In another example, the two threaded bosses are a substantially different height with respect to the front striking surface of the replaceable striking plate.

In yet another example, a fastener is inserted into each of the two threaded bosses. The two threaded bosses are configured to allow the fastener to engage with at least two threads when fully engaged.

According to one example, the recessed region includes a back support surface and a ledge surface. The ledge surface is located between the back support surface and the striking face of the main body in a front to back direction perpendicular to a face plane.

According to another exemplary embodiment, the ledge surface is located around a 360° perimeter of the back support surface within a plane parallel to the face plane.

According to yet another exemplary embodiment, at least one indicia is located on the rear surface of the replaceable striking plate and at least one opening is located in the rear portion of the main body. The opening is positioned to allow the indicia to be visible through the opening after the replaceable striking plate is attached to the front portion of the main body.

In one exemplary embodiment, one or more gaskets are located between the replaceable striking plate and the front portion of the main body.

According to one aspect of an embodiment of the present invention, an iron-type golf club head is described having a main body including a heel portion, a sole portion, a toe portion, a top-line portion, a front portion, a rear portion, and a striking face.

A replaceable striking plate located on the front portion of the main body. The replaceable striking plate includes a front surface and a rear surface and further includes at least one threaded opening located on the rear surface of the replaceable striking plate. The rear surface may include a plurality of regions. In one exemplary embodiment, the rear surface includes a first region and a second region, which may be substantially planar regions. These regions may be in different planes such that the total thickness of the first region and the second region may be different, for example. One region may directly engage the back support surface of the golf club head, and one region may compress a gasket located between the region and the back support surface. The front portion of the main body includes a recessed region including a relief region. The relief region forms an O-shape.

According to one aspect of an embodiment of the present invention, a striking plate is described having a front surface, a rear surface, and a relief region extending around an entire perimeter of the striking plate. A threaded portion on the rear surface can be engaged by a fastening member.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 1A:
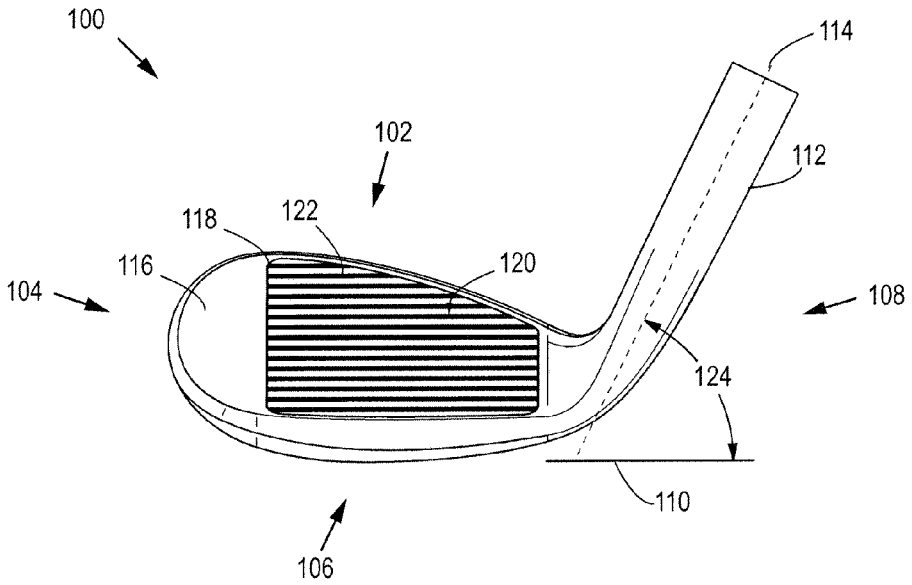
FIG. 1A is a front view of an embodiment of a golf club head.

FIG. 1A illustrates a golf club head 100 including a hosel 112, hosel axis 114, a top portion 102, a sole portion 106, a toe portion 104, and a heel portion 108. The golf club head 100 is positioned at an address position with respect to the ground 110 and includes an address loft angle 130 (see FIG. 1B) and lie angle 124 measured from the hosel axis 114. The golf club head 100 further includes a front striking surface 116 that includes a replaceable front striking plate 120 having an outer contour 118 and grooves 122 located on a front surface. The grooves or score lines 122 have a score line length equal to or less than the width of the replaceable striking plate 120 to allow for easy removal and replacement of the grooves or score lines 122 when the replaceable striking plate 120 is replaced.

Figure 1B:
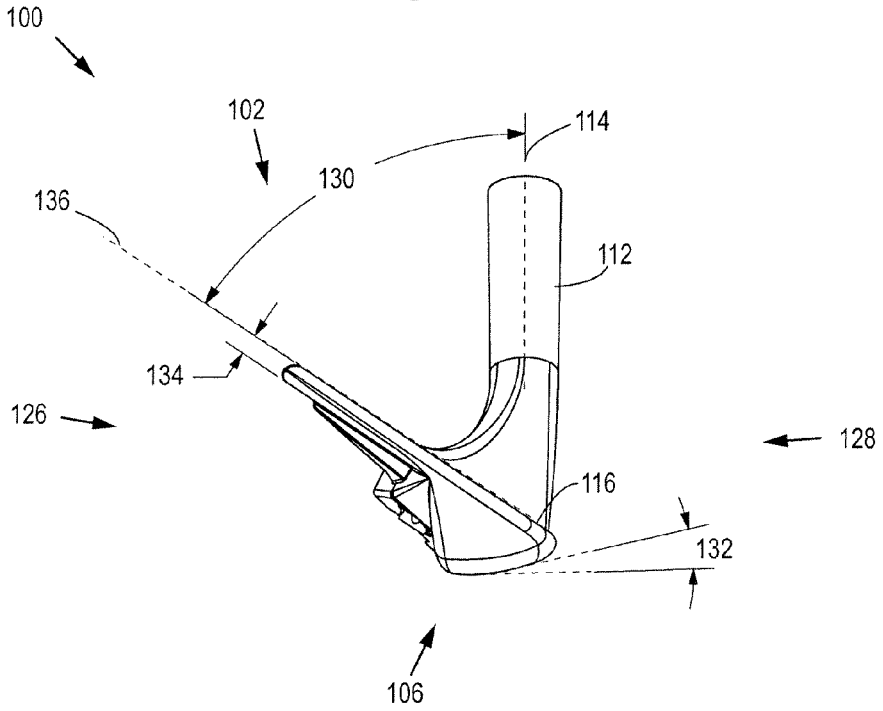
FIG. 1B is a side view of the golf club head in FIG. 1A.

FIG. 1B illustrates a toe side view of the golf club head 100 including a front portion 128, rear portion 126, a loft angle 130, a bounce angle 132, a top line thickness 134, and a face plane 136.

In certain embodiments, the top line thickness 134 is between about 2 mm and about 10 mm or about 7 mm or less. In some embodiments, the top line thickness 134 is about 5 mm or less. A thin top line thickness 134 has an advantageous effect of causing the golf club to resemble a classic blade or thin club face (which is desirable to many golfers). The embodiments described herein, achieve a thin top line while simultaneously providing a replaceable face golf club head.

The face plane 136 is an imaginary plane that is parallel and co-planar with the striking surface 116. Consequently, the front portion of the striking plate 120 is also coplanar with the face plane 136.

Figure 2:
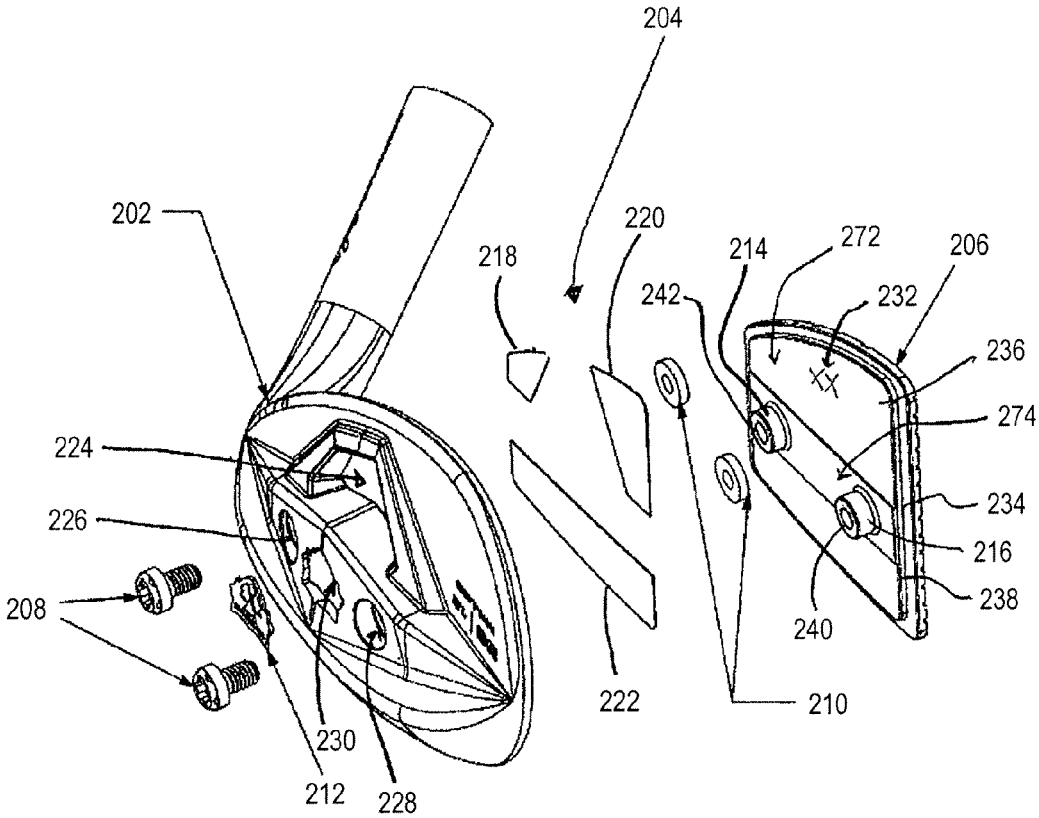
FIG. 2 is an exploded assembly view of a golf club head according to an embodiment.

FIG. 2 illustrates an exploded assembly view 200, according to an embodiment, including a main body portion 202, a replaceable striking plate 206, and an intermediate layer assembly 204.

The main body portion 202 includes a front and rear portion as previously described. In addition, the main body portion 202 includes a first opening 224, a second opening 226, and a third opening 228. The main body portion 202 further includes a badge recess 230 for receiving a badge 212 that can be adhesively or mechanically attached. The badge 212, in certain embodiments, could be a weight chip for lowering the center of gravity of the club head. As shown, the badge 212 is located between the second opening 226 and third opening 228.

The first opening 224 is located above the second 226 and third 228 openings with respect to the face plane. The second 226 and third 228 openings are positioned toward the heel and toe portions, respectively, to receive screws or bolts 208 and portions of a heel boss 214 and toe boss 216. The first opening or hole 224, in one embodiment, allows an indicia 232 to be viewed through the first opening 224. In other words, when the club head 200 is fully assembled, the indicia 232 located on the rear surface of the replaceable striking plate 206 is visible through the first opening 224. It is understood that the first opening 224 can be any number of openings such as at least two, three, four, or five openings or more in order to allow the indicia 232 to be seen.

The indicia 232 can be any kind of markings, letters, numbers, or color variations to indicate to the golfer the type of face plate or score line grooves currently attached to the main body of the golf club head. For example, the indicia 232 can indicate the amount of loft, the groove type, material type, groove spacing, groove depth, groove width or length or general dimensions, club head bounce, or indicia indicating the level of performance provided by the grooves. The indicia 232 can indicate the type of material, manufacturing process (such as milling), coating type, player type, feel type, symbol or logo.

The intermediate layer assembly 204 can be a gasket assembly 204 that is made up of a plurality of gasket components. The gasket assembly 204 is positioned between the main body portion 202 and the replaceable striking plate 206. The gasket assembly 204 includes first, second and third gasket components, 218, 220 and 222. The first component 218 is primarily aligned with one region of striking plate 206, and the second and third components 220 and 222 align with other regions of striking plate 206.

The gasket assembly 204 reduces the amount of potential rattle or unwanted sound created between the striking plate 206 and main body portion 202. In addition, the gasket assembly 204 may promote an even pressure distribution across the face plane upon assembly. In other words, the gasket assembly 204 allows for an increase in manufacturing tolerance with respect to engaged portions or surfaces of the striking plate 206 and main body portion 202. For example, a slightly uneven engagement surface will produce fewer stress concentrations between the striking plate 206 and main body portion 202 when the gasket assembly 204 is utilized. Depending on the material, the gasket assembly 204 can also improve the vibration and feel of the golf club at impact.

In certain embodiments, the gasket can be made of an elastic material such as rubbers, polymers, foams, plastics, injection molded plastics, organic materials (such as cork), or other suitable compliant material which can improve the feel of the golf club at impact. The gasket can be adhesively applied to either the main body or the striking plate surface.

Some other examples of materials that can be used as a gasket material include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the gasket material may have a modulus of elasticity ranging from about 0.001 GPa to about 25 GPa, and a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240. Preferably, the gasket material can be a microcellular urethane such as a PORON® foam gasket having a modulus range of 2-90 psi at 25% deflection.

The striking plate 206 further includes a back surface 236 and a step surface 234 that extends around a periphery of the back surface 236. The back surface 236 and step surface 234 are connected by a raised wall 238 which extends away from the entire outer periphery of the back surface 236 towards the step surface 234. The striking plate further includes a first rear surface region 272 and a second rear surface region 274. First rear surface region 272 may be dimensioned such that rear surface region 274 is on a different plane than rear surface region 272, although this will be explained in greater detail later. Further details of the striking plate will be discussed in further detail below.

FIG. 2 further shows two washers 210 that are threadingly engageable with the screws or bolts 208. The washers 210 can be initially unthreaded or pre-threaded prior to the insertion of the screws 208. After the screws 208 are threaded through the washers 208, the screws 208 engage a heel-side threaded bore 242 and a toe-side threaded bore 240 located within the heel 214 and toe 216 bosses, respectively. It is understood that the bores can be replaced with male threaded portions and can be secured to the back portion with nuts or other retaining mechanisms on the rear portion of the main body.

Figure 3A:
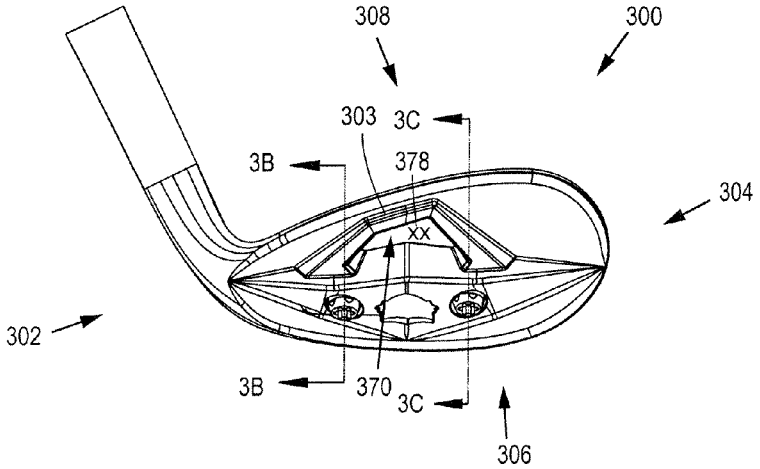
FIG. 3A is rear assembled view of a golf club head according to an embodiment.

FIG. 3A illustrates a rear view of a fully assembled club head 300 including a heel portion 302, toe portion 304, a top line portion 308, and a sole portion 306 similar to the club head described in FIG. 2. FIG. 3A further illustrates a bridge portion 303 located in the top line portion 308 and a viewing aperture 370 located below the bridge portion 303 to allow an indicia 378 to be viewed from a rear perspective. The bridge portion 303 acts to connect the toe portion 304 and the heel portion 302. The bridge portion 303 of the main body can act as a stabilizing member and helps to increase the rigidity and stiffness of the club head 300 while also providing the appearance of a thin top line which is desirable to a golfer, as discussed previously.

Figure 3B:
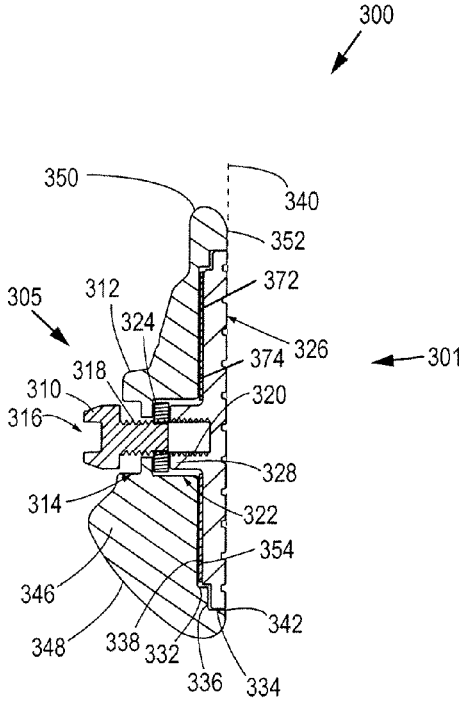
FIG. 3B is a cross-sectional view taken along section lines 3B-3B in FIG. 3A.

FIG. 3B is a cross-sectional view of cross section lines 3B-3B in FIG. 3A when a fastening member 316 is withdrawn but still engaged with a washer 324. A main body 346 includes a front portion 301, a rear portion 305, and a gasket assembly 354.

The main body 346 includes a through hole having a rear counter bore 314 and a front counter bore 322. The main body 346 further includes a back surface 312, a sole surface 348, a top line surface 350 and a front surface 352. The top line surface 350 is continuous from a heel-to-toe direction.

The front surface 352 of the main body 346 is generally co-planar with a face plane 340. The main body 346 further includes a back support surface 338 that is generally parallel with the face plane 340 and an opening wall 334 that is generally perpendicular to the face plane 340. The front surface 352 of the main body 346 and the opening wall 334 converge at a recessed region edge 342 that defines the recessed region.

A stepped region or relief region is located around a 360° perimeter of the back support surface 338 within a plane parallel to the face plane 340. The stepped region includes a ledge surface 336 and a side surface 332. The ledge surface 336 extends away from the opening wall 334 inwardly toward a central region of the club head. The ledge surface 336 and side surface 332 intersect at an edge. The side surface 332 extends away from the ledge surface 336 toward a rear portion of the club head.

The back support surface 338 is the primary load bearing surface between the striking plate 326 and the main body 346. In one embodiment, back support surface 338 includes a first rear surface region 372 and a second rear surface region 374. As illustrated in FIG. 3B, first rear surface region 372 lies in a different plane than second rear surface region 374. In this embodiment, a thickness between first rear surface region 372 and face plane 340 is less than a material thickness between second rear surface region 374 and face plane 340. These rear surface regions lying in different planes may provide particular functionality. For example, when the striking plate 326 is coupled to main body 346, second rear surface region 374 may contact back support surface 338. Gasket assembly 354 may be placed in compression, but less than 100% compression so that the gasket assembly does not act as a rigid body. For example, gasket assembly 354 may be placed in 50-80% compression, although the scope of the subject matter is not limited in this respect. This may result in a face plate 326 that has a substantially distributed load, resulting in a more flush overall assembly. When a ball impacts the striking plate 326, the load is distributed primarily over the back support surface 338 rather than the ledge surface 336 of the stepped region. As a result, the feel of the impact to the golfer is more desirable. A gap is provided between the ledge surface 336 and a step surface of the striking plate 326 around an entire perimeter. In addition, the gap extends around the stepped region to the side surface 332 so that the side surface 332 is also spaced away from a raised wall of the striking plate 326 around the entire perimeter, as will be shown in further detail.

In one example, the seam formed between the opening wall 334 and the striking plate 326 is flush with a gap tolerance of about +0.10 mm to about −0.15 mm to avoid creating a gap visible to the golfer on the face of the club. The gap tolerance can be between about +0.20 mm to about −0.20 mm about the entire 360° interface between the opening wall 334 and the striking plate 326. Thus, the lateral fit of the striking plate 326 depends primarily on the engagement between the opening wall 334 and a perimeter wall of the striking plate 326. Thus, a manufacturing advantage of having only the back support surface 338 and the opening wall 334 in direct contact with the striking plate 326 is that a minimal amount of machining is required on the striking plate 326 to maintain the overall striking plate thickness dimension and the perimeter wall dimension of the striking plate 326, as will be described in further detail.

The rear counter bore 314 accommodates the head portion 310 of the fastening member 316. In other words, when fully engaged, the head portion 310 of the fastening member 316 is recessed in the main body 346 to prevent unwanted contact with a ground surface during use or unwanted damage to the head portion 310 or fastening member. A head portion 310 that extends too far above a back surface 312 of the main body can catch the ground surface causing a disturbance to the golfer during a swing or even injury to the golfer or damage to the fastening member.

The fastening member can include any type of known thread such as M4×0.7 (metric) or within the range of M4×0.5 to M5×0.8. In alternative embodiments, a fastening member can have a thread type of #5-36 to #5-44 or #6-32 to #6-40.

The washer 324 is in threaded engagement with the fastening member 316 threaded portion 318 to retain the fastening member 316 within the through hole. In other words, the washer 324 prevents the fastening member 316 from fully disengaging from the through hole unless the fastening member 316 is fully disengaged from the washer 324. The washer 324 is retained within a front counter bore 322 and can be threaded or unthreaded.

In certain embodiments, the washer 324 can be a type of washer that prevents the fastening member 316 from fully disengaging all together. The washer is defined as any ring like object capable of retaining the fastening member 316. The washer 324 could have a rotational limiting mechanism or stop mechanism that prevents the fastening members 316, 330 from being easily removed. An advantage of a stop mechanism is that the fastening members 316, 330 would be constantly attached to the main body and thereby prevent the fastening members 316, 330 from being misplaced or lost by the user. In another embodiment, C-clips instead of washers can act as a stop mechanism. The washer member or C-clip can travel with the screw and is fixed to the fastening member. The C-clip could snap into a groove on the shank of the fastening member so that the C-clip moves with the fastening member when the fastening member is rotated. The C-clip could facilitate self extraction of face. In other words, during disengagement of the fastening member, the C-clip would contact the bottom surface of the counter bore preventing further motion of the fastening member and forcing the forward motion of the striking plate through thread engagement with the striking plate.

FIG. 3B shows a heel-side fastening member 316 having a head portion 310. The fastening member 316 includes a threaded portion 318 that passes through the through hole and washer into the threaded boss. The club head 300 includes a main body 346 and a striking plate 326 that is removably attached to the main body 346 by being disengaged from the fastening member 316.

If both fastening members are disengaged from the threaded bosses 328, 360 of the striking plate 326, the striking plate 326 can be easily removed and replaced. In one embodiment, back support surface 338 of the striking plate 326 includes a first rear surface region 372, a second rear surface region 374, and a boss 328 having a cylindrical shape and a threaded inner diameter 320. In a release position, the fastening member 316 threaded portion 318 is disengaged from the threaded inner diameter 320 of the boss 328.

Figure 3C:
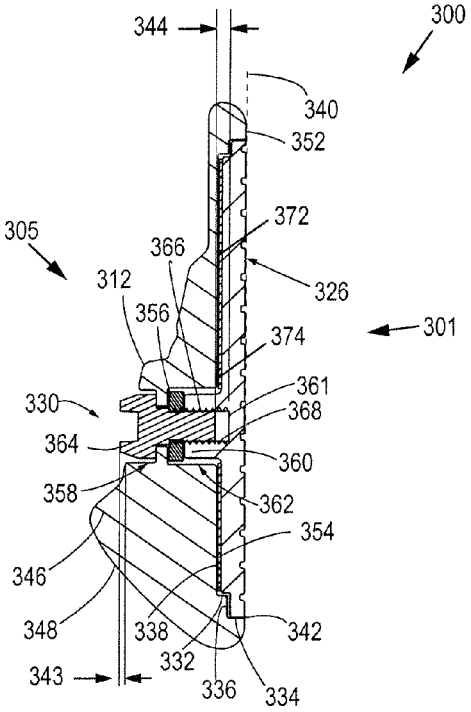
FIG. 3C is a cross-sectional view taken along section lines 3C-3C in FIG. 3A.

FIG. 3C illustrates a cross-sectional view taken along cross section lines 3C-3C in FIG. 3A when a toe-side fastening member 330 is fully engaged with a washer 356 and threaded bore 360.

In the fully engaged position, the fastening member 330 includes a head portion 364 that is fully recessed within a rear counter bore 358. As mentioned above, this enables the rearmost portion of the fastening member 330 to be embedded within the back surface 312. Thus, in certain embodiments the rearmost portion of the head portion 364 protrudes above the back surface 312 by a protruding distance 343 of less than about 20 mm or 5 mm (with respect to the rearmost adjacent edge of the rear counter bore 358) as measured along an axis perpendicular to the face plane 340.

The fastening member threads 366 fully engage the toe-side washer and boss threads 368 of the toe-side boss 360. The boss 360 is fully inserted into the front counter bore 362 to allow full engagement of the fastening member 330 and boss 360. Furthermore, in the fully engaged position, a minimum fastening member clearance or screw clearance 344 is provided to avoid undesirable contact between the bottom of the fastening member 330 and a bottom surface 361 of the boss 360. In some embodiments, the screw clearance 344 is between about 0.50 mm and about 3 mm, or about 1.0 mm to about 1.5 mm.

Furthermore, in the fully engaged position, the washer 356 is located entirely within the front counter bore 362 and engages a top surface of the boss 360. In other words, the washer 356 is retained between the boss 360 and a bottom surface of the front counter bore 362.

In certain embodiments, at least about 3.0 to about 5.0 fastening member threads 366, 318 are engaged with the boss threads 320, 368 to ensure the striking plate 326 is safely secure. In some embodiments, more than 5.0 fastening member threads 366, 318 can be engaged. In some embodiments, 2.0 or more threads must be engaged in order to prevent the loosening of the striking plate 326, as will be described in further detail.

Figure 4A:
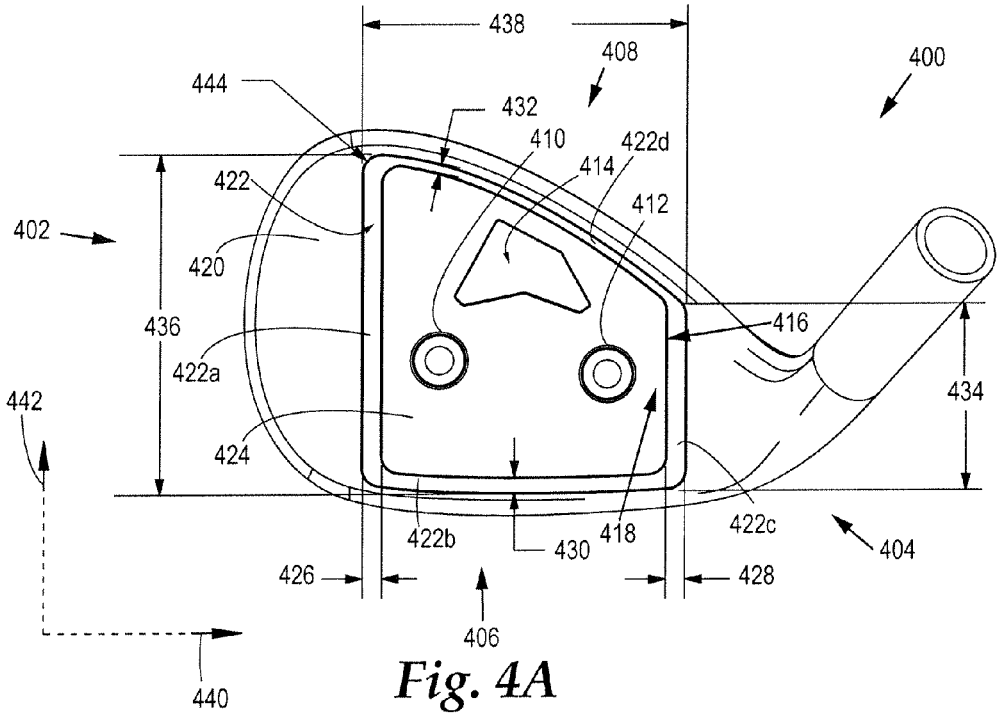
FIG. 4A is a front view of a main body according to an embodiment.

FIG. 4A illustrates a front view of an exemplary embodiment of a main body 400 including a toe portion 402, heel portion 404, sole portion 406, and top line portion 408. A reference x-axis 440 and y-axis 442 are also shown within the face plane of the striking surface 420. The main body 400 is shown without a striking plate and further includes a toe-side counter bore 410 and a heel side counter bore 412 and respective through holes. A viewing aperture 414 is also shown on the main body enabling a user to view indicia located on the back surface of a striking plate as previously described.

Furthermore, a relief region or stepped region 416 is positioned around the entire 360° periphery of a recessed region 418. The recessed region 418 is defined as a region that is recessed away from the striking surface 420 of the golf club head 400 and away from a striking face plane. Because the relief region or stepped region 416 is located around an entire periphery of the recessed region 418, the relief region or stepped region 416 creates an O-shape as viewed from the front portion.

The relief region or stepped region 416 being located about the entire periphery of the recessed region 418 ensures the striking plate can be inserted without jamming. The stepped region 416 can be replaced with any relief region geometry such as a chamfer, radius, or multiple steps to reduce the contact area between the striking plate and the main body. The stepped region is convenient to manufacture quickly and efficiently when compared to other types of relief region geometries. FIGS. 8-13 illustrate a number of alternative embodiments defining various geometries of a relief region 800, 900, 1000, 1100, 1200, 1300 and various gaps 802, 902, 1002, 1102, 1202, 1302 associated with the respective relief regions. As described herein, the relief regions 416, 800, 900, 1000, 1100, 1200, 1300 and respective gaps are critical in reducing the amount of surface area requiring a high amount of precision with respect to dimensional tolerances. In some embodiments, the gaps of the relief region reduce the amount of surface area contact between the opening wall and the perimeter wall of the striking plate by as much as about 50% or between about 10% and about 90%. In one embodiment, the relief region can be defined as the area in which the striking plate and the main body are not in contact or separated by a gap. In some embodiments, a ledge surface 422 and a back support surface 424 define the depth of the recessed region 418. The stepped region 416 includes the ledge surface 422 about the entire periphery of the recessed region 418. The ledge surface 422 and the back support surface 424 are generally parallel with the striking surface plane. The ledge surface 422 is located between the back supports surface 424 and the striking surface 420 in a front to back direction that is perpendicular to the face plane.

The ledge surface 422 further includes a toe-side ledge surface portion 422*a*, a sole-side ledge surface portion 422*b*, a heel-side ledge surface portion 422*c*, and a top-line-side ledge surface portion 422*d*.

The toe-side ledge surface portion 422*a* has a length dimension 436 of between about 30 mm and about 70 mm, or less than about 60 mm with respect to the y-axis 442. The y-axis 442 is generally perpendicular to any horizontal striking face grooves that may be present. In contrast, the x-axis 440 is generally parallel to any horizontal striking face grooves that may be present. Furthermore, the heel-side ledge surface portion 422*c* has a length dimension 434 of between about 10 mm and 50 mm, or less than about 40 mm. The heel-side ledge length dimension 434 is less than the toe-side ledge length dimension 436.

In certain embodiments, the toe-side ledge surface portion 422*a* and the heel-side ledge surface portion 422*c* have a width 426, 428, respectively, of between about 0 mm and about 20 mm as measured along the x-axis 440. In one exemplary embodiment, the toe-side ledge surface portion width 426 and the heel-side ledge surface portion width 428 are between about 1 mm and about 15 mm, or less than about 10 mm or less than about 5 mm. In some embodiments, the sole-side ledge surface portion 422*b* has a width 430 of between about 1 and about 20 mm or less 10 mm. In certain embodiments, the sole-side ledge surface portion width 430 is less than each of the toe-side ledge surface portion width 426 and the heel-side ledge surface portion width 428. In one embodiment, the sole-side ledge surface portion width 430 is less than 5 mm. The sole-side ledge surface portion width 430 is measured with respect to the y-axis 442.

In certain embodiments, the top-line side ledge surface portion width 432 is less than each of the other ledge surface portion widths 426, 428, 430. In some exemplary embodiments, the top-line side ledge surface portion width 432 is between about 0 mm and about 20 mm or less than about 5 mm or about 10 mm. The top-line ledge surface portion width 432 is measured along an axis that is perpendicular to the curvature of the top-line ledge trajectory at the point of measurement. In some embodiments, the total width 438 of the recessed region 418 is between about 40 mm and 60 mm or less than about 70 mm.

FIG. 4A further shows a transition region 444 is provided between each of the ledge surface 422 transitions between the toe-side ledge surface portion 422*a*, the sole-side ledge surface portion 422*b*, the heel-side ledge surface portion 422*c*, and the top-line-side ledge surface portion 422*d*. In some embodiments, the transition region 444 is a radius between about 1 mm and about 15 mm, or less than about 5 mm. The transition region 44 can be a chamfer or any other corner type shape.

In some embodiments, the striking surface 420, the ledge surface 422, and the back support surface 424 can be initially cast and then milled or machined. In one embodiment, a 0.3 mm to 1.0 mm machine stock plate can be added to any surface to increase tolerance control. After casting or forging, the surface can be slightly milled or engraved, if desired.

Figure 4B:
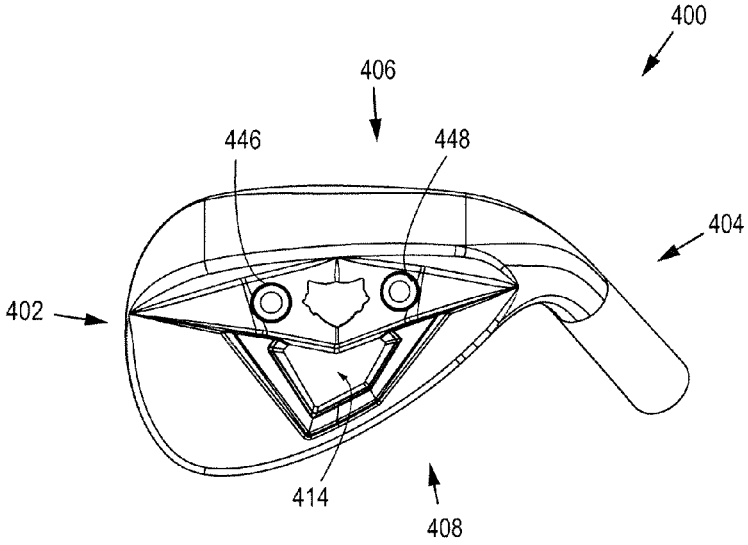
FIG. 4B is a rear view of the main body in FIG. 4A.

FIG. 4B is a rear view of the main body 400. The main body includes counter bores on the rear side of the main body 400. Specifically, a toe side counter bore 446 is shown and a heel side counter bore 448 is shown.

Figure 5A:
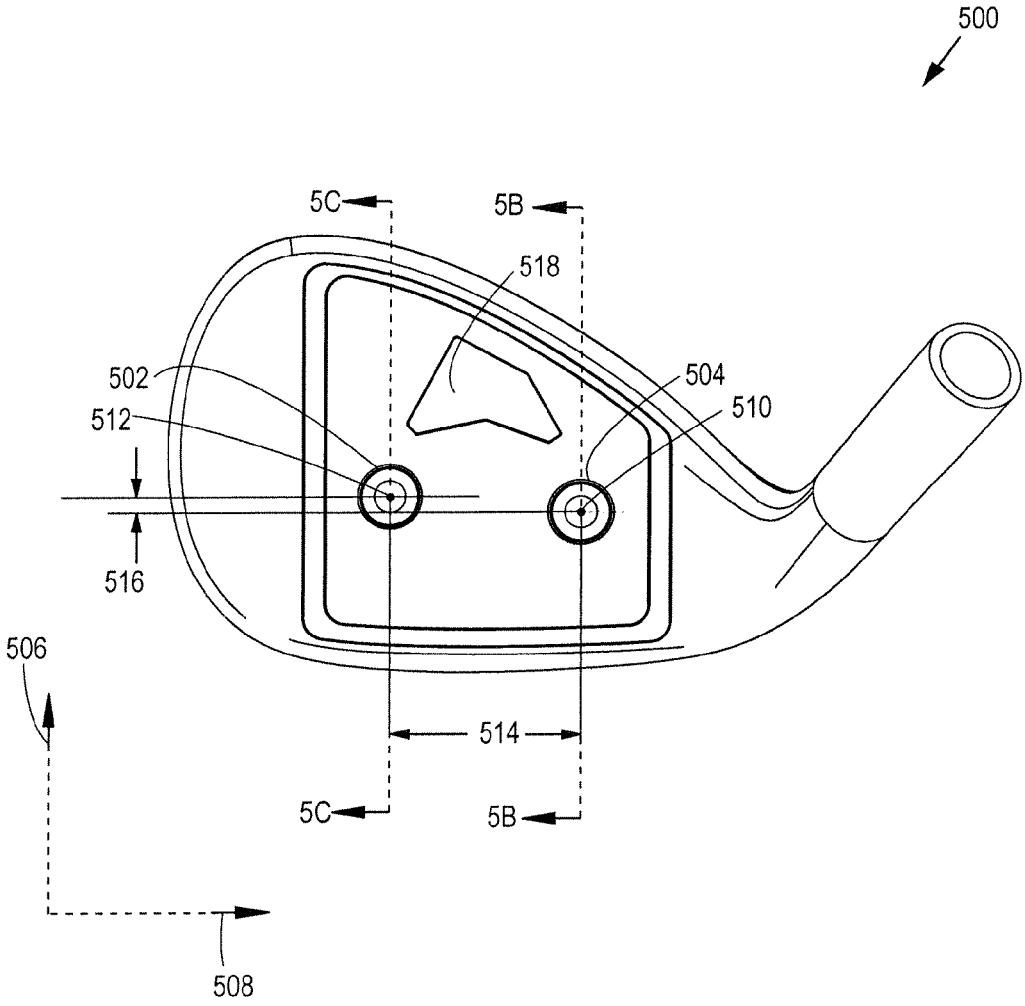
FIG. 5A is a front view of a main body according to an embodiment.

FIG. 5A illustrates a front view of the club head main body 500 including a toe-side counter bore 502 and a heel side counter bore 504 each having a respective through hole and an opening 518. A face plane y-axis 506 and x-axis 508 are shown as previously described. Each counter bore 502,504 and through hole contains a center point location 510, 512.

In certain embodiments, the lateral spacing distance 514 of the counter bores along the x-axis 508 between the center point locations 510, 512 is between about 5 mm and about 60 mm depending on the size of the striking face. In some embodiments, the vertical spacing distance 516 of the counter bores along the y-axis 506 between the center point locations 510, 512 is between about 0 mm and about 60 mm or between about 1 and 10 mm. Again, it is understood that some embodiments may only require one counter bore and screw.

Figure 5B:
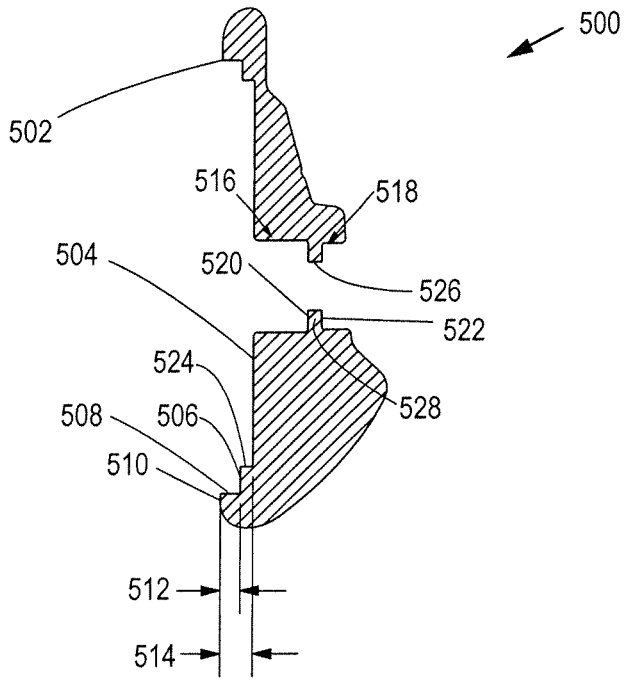
FIG. 5B is a cross-section view taken along section lines 5B-5B in FIG. 5A.

FIG. 5B illustrates a cross-sectional view of the main body 500 in FIG. 5A along cross-sectional lines 5B-5B. The main body 500 includes a recessed region edge 502, a back support surface 504, side surface 524, ledge surface 506, opening wall 508, a main body front surface 510, a front counter bore 516, and a rear counter bore 518 as previously described.

The front counter bore 516 includes a first bottom surface 520 and the rear counter bore 518 includes a second bottom surface 522. The through hole 526 along with the first bottom surface 520 and second bottom surface 522 define the dividing wall 528 that separates the first counter bore 516 and second counter bore 518.

FIG. 5B further shows an opening wall depth 512 and a total depth of the recessed region 514 as measured from the front surface 510 to the back support surface 504. In order to provide an adequate fit, the opening wall depth 512 must be thin enough to prevent jamming when inserting the face plate. Thus, the opening wall depth 512 is less than about 3 mm or less or about 2 mm or less. In some embodiments, the total depth of the recess region is about 3 mm or more.

Figure 5C:
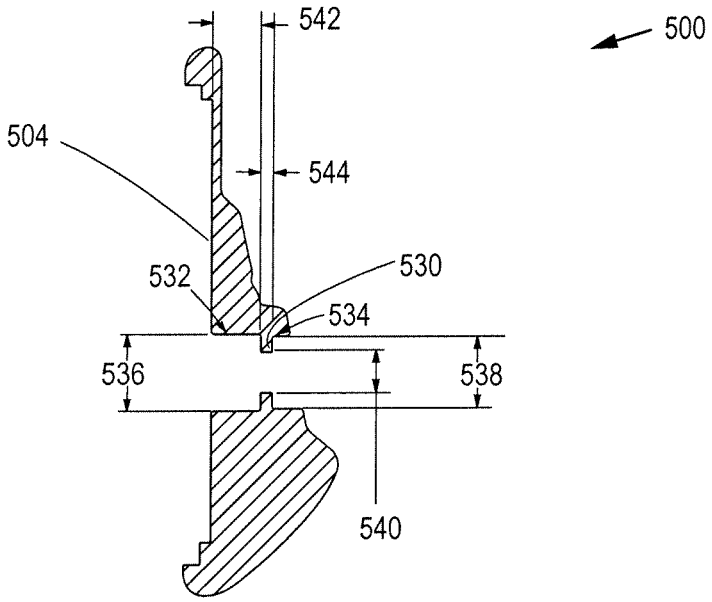
FIG. 5C is a cross-section view taken along section lines 5C-5C in FIG. 5A.

FIG. 5C illustrates a cross-sectional view of the main body 500 in FIG. 5A along cross-sectional lines 5C-5C. The cross section in FIG. 5C has similar features and dimensions described in FIG. 5B including a back support surface 504, a front counter bore 532, a rear counter bore 534 and a dividing wall 530.

In certain embodiments, the front counter bore 532 includes a front counter bore diameter 536 of less than 20 mm or about 10 mm or less. The rear counter bore 534 includes a rear counter bore diameter 538 of less than 20 mm or about 10 mm or less. In some embodiments, the front counter bore diameter 536 is greater than the rear counter bore diameter 538 to accommodate the insertion of the threaded bosses, as previous described. In addition, the depth 542 of the front counter bore 532 as measured from the back support surface 504 is about 10 mm or less to ensure the boss can be fully inserted. In some embodiments, the dividing wall 530 has a thickness 544 of less than about 3 mm or preferably less than 2 mm. The through hole diameter 540 can be less than 10 mm or about 5 mm or less. The through hole diameter 540 is critical in preventing cross-threading upon inserting the fastening members. It is understood that the features and dimensions described in FIGS. 5B and 5C can be identical to one another.

Figure 6A:
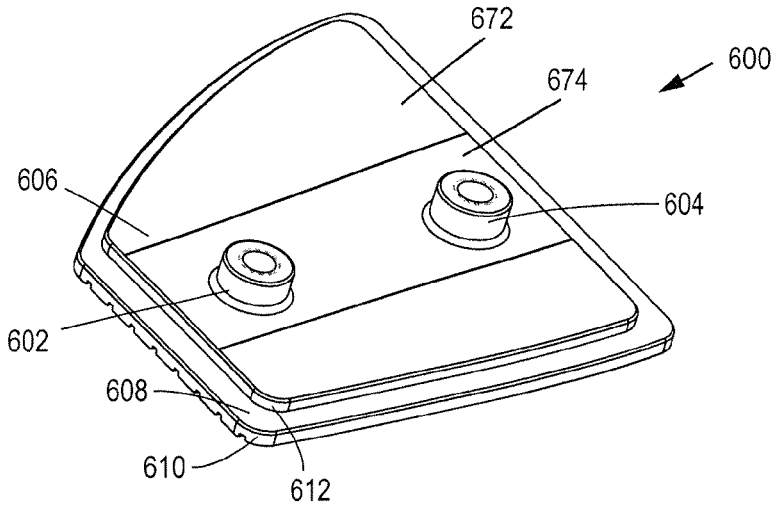
FIG. 6A illustrates an isometric view of a striking plate according to an embodiment.

FIG. 6A illustrates an isometric view of a striking plate 600 which can be inserted into a main body as described above. The striking plate 600 includes a first boss 602, a second boss 604, a back surface 606, a first rear surface region 672, a second rear surface region 674, a step surface 608, a raised wall 612, and a perimeter wall 610. As described above, the second rear surface region 674 directly engages with the back support surface of the main body and acts as the primary load bearing interface, and the first rear surface region typically includes a gasket assembly (not shown). When assembled, the first rear surface region 672 compresses the gasket assembly to a particular compression, such as a compression greater than 0% but less than 100%. In this embodiment, a thickness of first rear surface region 672 is less than a thickness of second rear surface region 674. These rear surface regions may provide particular functionality. For example, when assembled with a golf club head, the second rear surface region 674 may contact a back support surface of the golf club head while first rear surface region 672 places a gasket assembly in compression, but less than 100% compression so that the gasket assembly does not act as a rigid body. For example, a gasket assembly may be placed in 50-80% compression, although the scope of the subject matter is not limited in this respect. This may result in a more flush overall assembly. As a result, the feel of the impact to the golfer is more desirable. The compressed gasket assembly may ensure a flush striking plate and/or may absorb forces during impact. The raised wall 612 and step surface 608 are not the primary load bearing surfaces and generally are separated from the side wall and ledge surface of the main body by a gap. In certain embodiments, the second boss 604 is not the same height as the first boss 602 as will be described in detail further below.

However, the perimeter wall 610 is in direct contact and flush with the opening wall of the main body within the tolerances described above to create a seam. The perimeter wall 610 is generally perpendicular to a face plane.

In certain embodiments, the back surface 606 and the raised wall 612 define a separate piece that is separable from the step surface 608 and front striking plate surface. The raised pad defined by the back surface 606 and raised wall 612 is shown to be integral with the striking plate but can be a separate piece. If the raised pad defined by back surface 606 and raised wall 612 is separately attached, the raised pad can be made of any material described herein, such as foam, rubber, or plastic as mentioned.

In some embodiments, the face plate is one size and can fit any club within the set of clubs ranging from a 48° loft to a 64° loft. This provides the ability to swap different faces into different clubs having a different loft.

Figure 6B:
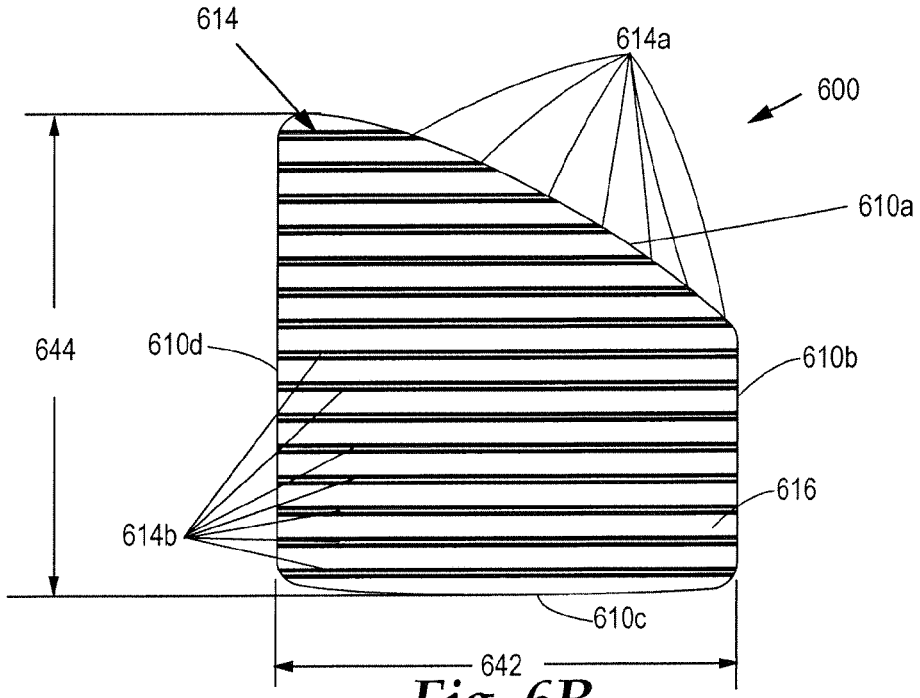
FIG. 6B is a front view of the striking plate in FIG. 6A.

FIG. 6B shows a front view of the striking plate 600 including score line grooves 614 and an intermediate non-grooved striking surface 616. The score line grooves 614 are in accordance with the USGA Rule of Golf.

The embodiments described herein conform with the USGA (United States Golf Association) Rules of Golf and Appendix II, 5c related to the Determination of Groove Conformance (issued in August 2008). For example, clubs having a loft of 25 degrees or higher meets the groove width, groove depth, groove separation, groove consistency, area limitations, and edge radius requirements set forth by the USGA. In the embodiments described herein, less than 50% of measured values of Area/(Width+Separation) are greater than 0.0030 $in^2/in$ and no single measured value of Area/(Width+Separation) value for any single groove is greater than 0.0032 $in^2/in$.

With respect to a groove edge radius, the groove edges are in the form of a radius conforming with the USGA Rules of Golf as described by the two circles method. In addition, the effective radius is not greater than 0.020". In the embodiments described, less than 50% of the upper groove edges or lower groove edges fails the two circles method subject to a 10 degree angular allowance as described in the USGA rules. No single groove edge protrudes more than 0.0003" outside the outer circle.

In certain embodiments, the striking plate 600 can be forged or formed from maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate 600 can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In one embodiment, the body portion is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

The components of the described components disclosed in the present specification can be formed from any of various suitable metals, metal alloys, or composites. For example, the striking plate 600 can be entirely a composite reinforced fiber material.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

FIG. 6B further shows the perimeter wall 610 including four segments: a top line segment 610*a*, a heel side segment 610*b*, a bottom segment 610*c*, and a toe side segment 610*d*. Each segment connects with another segment through a transition radius.

The score lines 614 extend horizontally across the entire striking plate surface from a heel-to-toe direction. In one example, the top line segment 610*a* includes about seven score lines 614*a* opening into the top line segment perimeter wall 610*a*. It is understood any number of score lines can open into any line segment of the perimeter wall 610, such as between about 1 and 20 score lines. The heel side segment 610*b* includes about eight score lines 614*b* breaking through the heel and toe perimeter wall 610. The toe side segment 610*d* includes about fifteen or all of the score lines 614 breaking through the toe side segment perimeter wall 610*d*. In certain embodiments, the score lines 614 break through heel and toe edges of the striking plate 600 on three sides or segments such as the top line segment 610*a*, the heel side segment 610*b*, and toe side segment 610*d*. In some embodiments, three of the four perimeter wall segments have score lines breaking through except the bottom segment 610*c*.

Because the score lines extend across the entire striking plate surface and are continuous across the entire striking surface, the manufacturing methods to create the score lines are greatly simplified and more efficient. In certain embodiments, the score lines 614 can be efficiently manufactured by milling of any kind such as end milling, gang cutter milling, a saw blade cut or gang cutter saw blade cutting. Multiple score lines can be cut in one manufacturing cycle.

In some embodiments, the striking surface 616 is a textured surface as described in U.S. Pat. Nos. 7,278,928 and 7,445,561 which are incorporated by reference herein in their entirety. The striking surface 616 can be coated with any type of abrasive or performance enhancing coating such as tungsten carbide coating, diamonds, zirconium, aluminum, copper, aluminum bronze, nickel or ceramics.

Figure 6C:
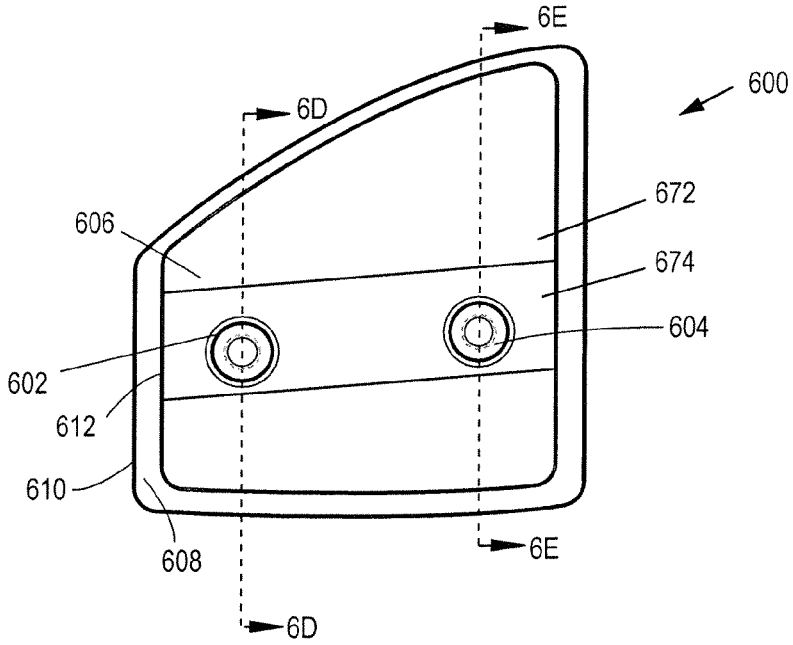
FIG. 6C is a rear side view of the striking plate in FIG. 6A.

The overall width 642 and height 644 of the striking plate 600 can range between about 20 mm and about 70 mm or preferably between about 40 mm and about 60 mm FIG. 6C illustrates a rear view of the striking plate 600 including the first boss 602, the second boss 604, the back surface 606, first rear surface region 672, second rear surface region 674, the step surface 608, the raised wall 612, and the perimeter wall 610.

Figure 6D:
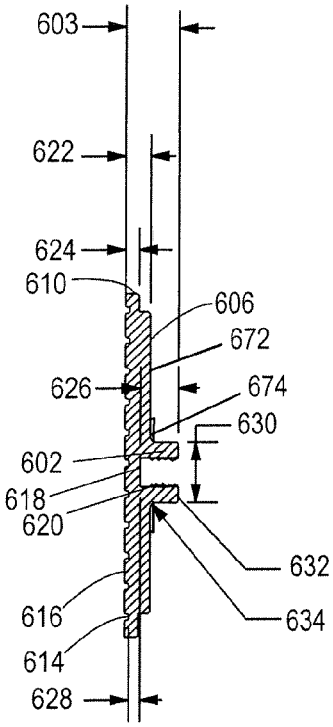
FIG. 6D is a cross-section view taken along section lines 6D-6D in FIG. 6C.

FIG. 6D is a cross-sectional view of cross section lines 6D-6D in FIG. 6C. FIG. 6D further shows the first boss 602 including a flat bottom surface 618 being generally parallel to the striking surface and a threaded portion 620 within the first boss 602 inner diameter. The flat bottom surface 618 is accomplished by a flat bottom bore with no drill point geometry. Therefore, a maximum amount of thread engagement is possible between the fastening member and the boss without having a very tall boss. In certain embodiments, the boss threads can be thread milled to achieve full depth threads instead of a traditional tap and die process.

The first boss 602 and second boss 604 are different heights to accommodate the curvature of the rear portion of the club head. If the bosses are of the exact same height, one fastener head may undesirably protrude from the back surface (depending on the contour) of the rear portion of the club head potentially causing more friction with a ground surface or grass during a swing.

The advantage of having different boss heights 603, 605 in each boss is that a maximum amount of threads can be achieved in each boss and therefore the two screws being inserted into the first and second boss 602, 604 can be of the exact same type and height. Therefore, user confusion is reduced by utilizing two screws of the same type and height that can both adequately engage with the shorter first boss 602 and the taller second boss 604.

In certain embodiments, the first boss 602 total height 603 is about 5.6 mm or less than about 6 mm as measured from the front striking surface 616. The thickness 628 of the striking plate 600 between the flat bottom surface 618 and the bottom of each score line 614 is at least about 1 mm or more to avoid any potential cracking or material failure. The total thickness 622 of the striking plate 600 between the front striking surface 616 and the back surface 606 is less than about 3 mm or less than 5 mm. In at least one embodiment, the total thickness between the front striking surface 616 and the first rear surface region 672 is less than the total thickness between the front striking surface 616 and the second rear surface region 674. This thickness difference may be less than approximately 1 mm in at least one embodiment, but the scope is not so limited and other thickness differences, such as thickness differences between about are within the scope of the claimed subject matter.

In one embodiment, the depth 624 of the perimeter wall 610 is about 1.55 mm or less than about 2 mm or 3 mm. In some embodiments, the first bore depth 626 of the bore within the first boss 602 is between about 4 mm and about 4.5 mm or less than 5 mm. The bore depth 626 is measured from the boss top surface 632 to the flat bottom surface 618. The outer diameter 630 of the first boss is about 7 mm or less or less than about 10 mm. The attachment of the first boss 602 to the back surface 606 includes a radius 634 of less than about 1 mm to reduce potential stress concentrations.

Figure 6E:
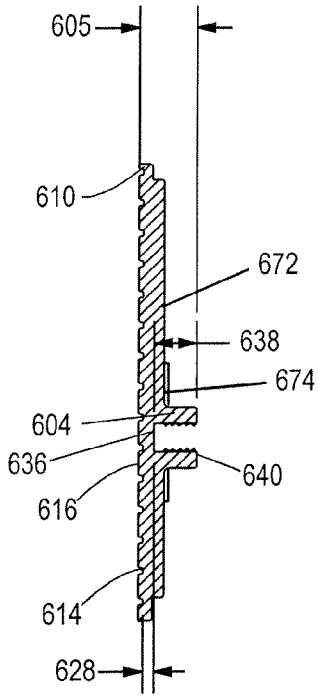
FIG. 6E is a cross-section view taken along section lines 6E-6E in FIG. 6C.

FIG. 6E is a cross-sectional view of cross section lines 6E-6E in FIG. 6C. FIG. 6E illustrates the same features and dimensions as described in FIG. 6D with some exceptions. As previously noted, the height of the second boss 604 is slightly higher than the first boss 602. In one embodiment, there is about 0.5 mm in height difference between the first boss 602 and second boss 604. In some embodiments, the first boss 602 may be higher than the second boss 604.

In certain embodiments, the total height 605 of the second boss 604 is about 6 mm or more as measured from the striking face 616. The second boss bore depth 638 of the second boss 604 bore as measured from a flat bottom surface 636 to the top surface 640 of the boss is about 4.8 mm or more or between about 4.5 mm and 5 mm.

Because the above bosses 602, 604 can be of different height with an adequate amount of thread engagement, the fastening member can fully engaged the threaded inner diameter by at least about two full thread engagements or at least about 3.75 threads are fully engaged. In some embodiments, the first boss 602 and second boss 604 have the exact same amount of thread engagement when the engaging member is fully engaged. In one embodiment, the first and second boss 602, 604 both have at least 4 mm of thread engagement within each bore as measured from the top surfaces 632, 640.

With the above thread engagements, a minimum clamping force of about at least 100 $lb_f$ (i.e., total clamping force of 200 $lb_f$) or at least about 1,000 $lb_f$, when utilizing a 40 in-lb. torque wrench on each fastening member, is achieved. In one embodiment, a total clamping force between the striking plate 600 and the main body is about 2,500 $lb_f$ or less. The advantage of having two bosses and two fastening members is that the amount of clamping force between the striking plate 600 and main body is doubled.

Figure 7:
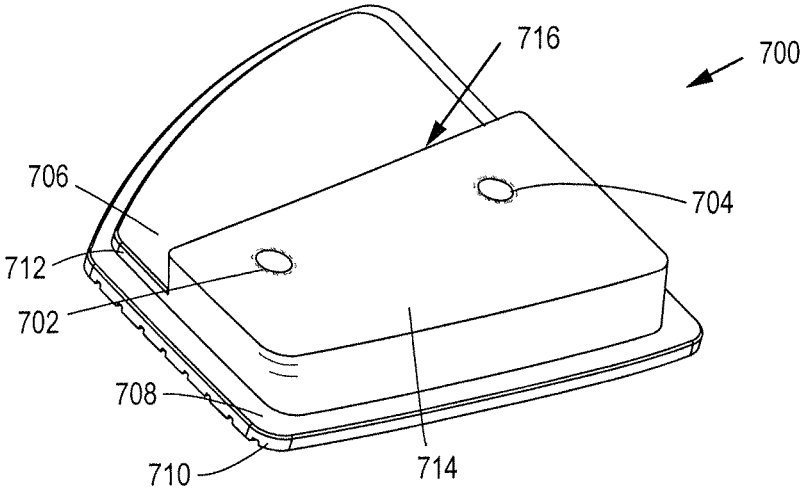
FIG. 7 illustrates an isometric view of a striking plate according to another embodiment.
Figure 8:
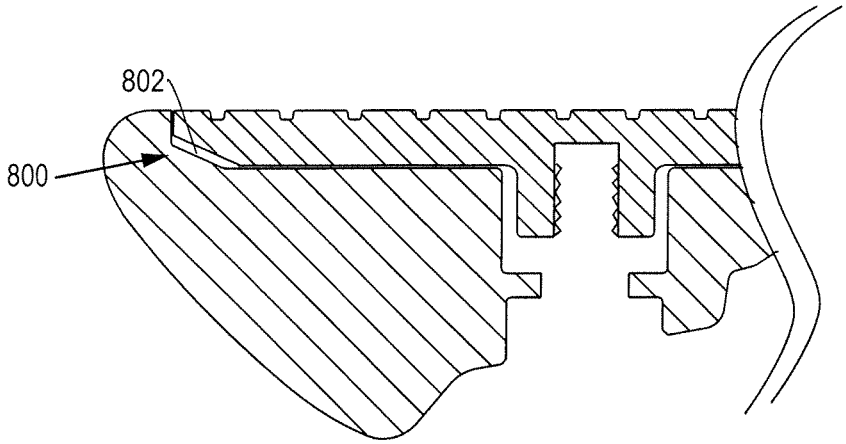
FIG. 8 illustrates a detail view of a relief region and a gap, according to another embodiment.
Figure 9:
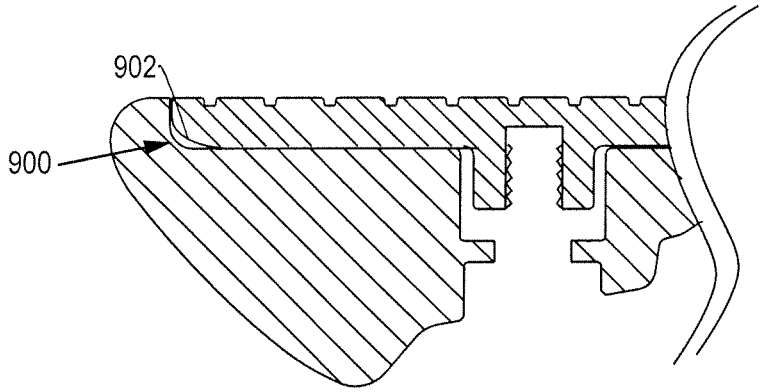
FIG. 9 illustrates a detail view of a relief region and a gap, according to another embodiment.
Figure 10:
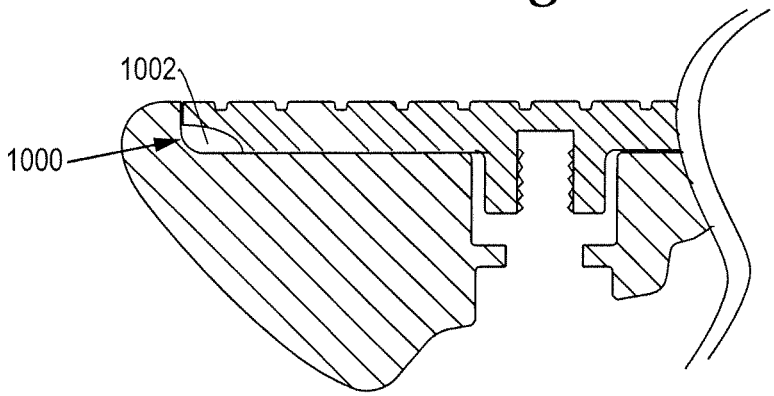
FIG. 10 illustrates a detail view of a relief region and a gap, according to another embodiment.
Figure 11:
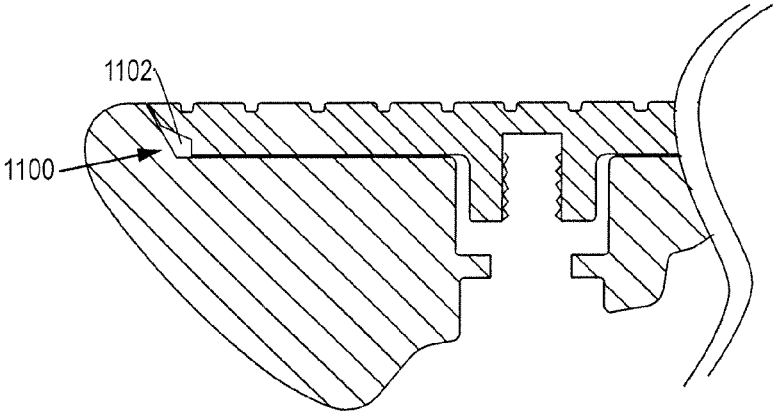
FIG. 11 illustrates a detail view of a relief region and a gap, according to another embodiment.
Figure 12:
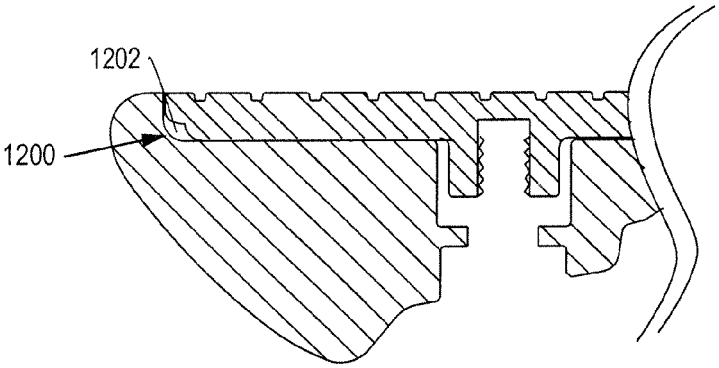
FIG. 12 illustrates a detail view of a relief region and a gap, according to another embodiment.
Figure 13:
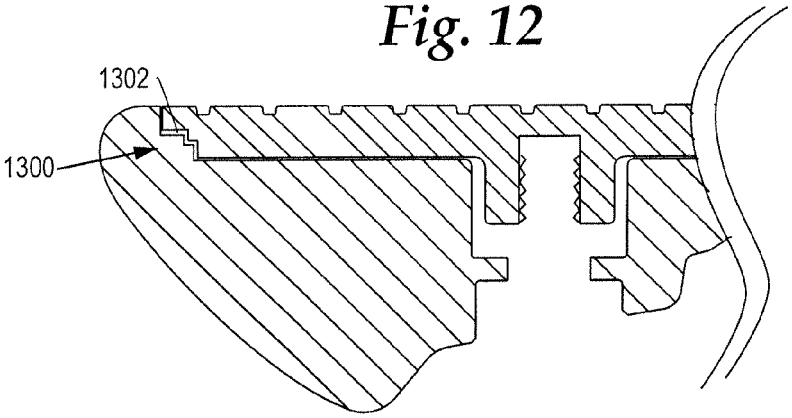
FIG. 13 illustrates a detail view of a relief region and a gap, according to another embodiment.

FIG. 7 illustrates another embodiment of a striking plate 700. Instead of the bosses, a mass pad 714 is provided with a first threaded hole 702 and a second threaded hole 704. The striking plate also includes a back surface 706, a step surface 708, a raised wall 712, and a perimeter wall 710 as previously described. The mass pad 714 requires a higher raised wall 712 about the perimeter and includes a stepped region 716 between the mass pad and the back surface 706. It is understood that the main body recessed region would be modified to fit the contour of the mass pad 714.

FIGS. 8-13 illustrates various detail views of a relief region and a gap, according to various embodiments.

Figure 14:
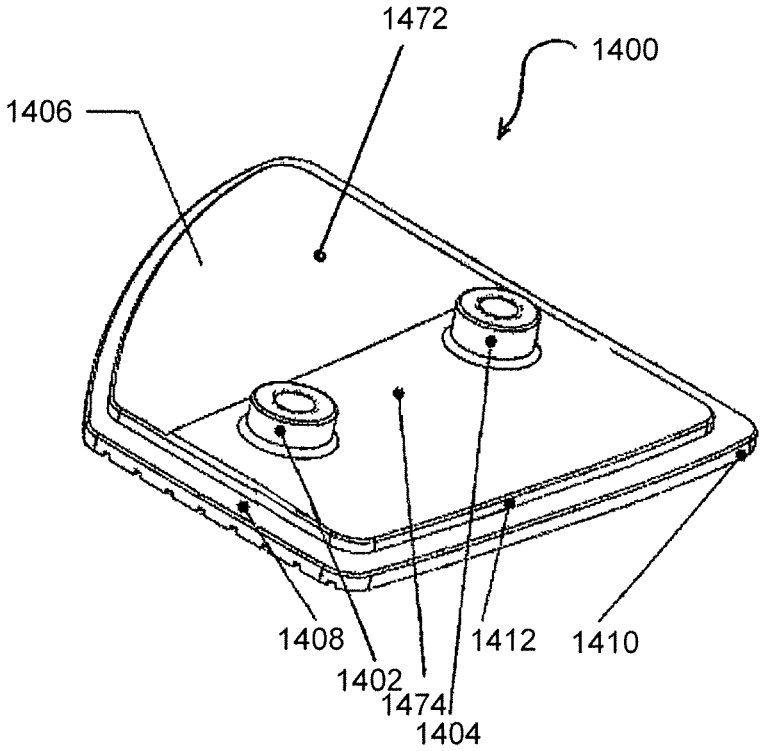
FIG. 14 illustrates an isometric view of a striking plate according to another embodiment.

FIG. 14 illustrates another embodiment of a striking plate 1400. The striking plate 1400 includes a first boss 1402, a second boss 1404, a back surface 1406, a first rear surface region 1472, a second rear surface region 1474, a step surface 1408, a raised wall 1412, and a perimeter wall 1410. The second rear surface region 1474 directly engages with the back support surface of the main body and acts as the primary load bearing interface, and the first rear surface region typically includes a gasket assembly (not shown). When assembled, the first rear surface region 1472 compresses the gasket assembly to a particular compression, such as a compression greater than 0% but less than 100%. The compressed gasket assembly may ensure a flush striking plate and/or may absorb forces during impact. The raised wall 1412 and step surface 1408 are not the primary load bearing surfaces and generally are separated from the side wall and ledge surface of the main body by a gap. In certain embodiments, the second boss 1404 is not the same height as the first boss 1402.

In some embodiments, the face plate is one size and can fit any club within the set of clubs ranging from a 48° loft to a 64° loft. This provides the ability to swap different faces into different clubs having a different loft.

Figure 15:
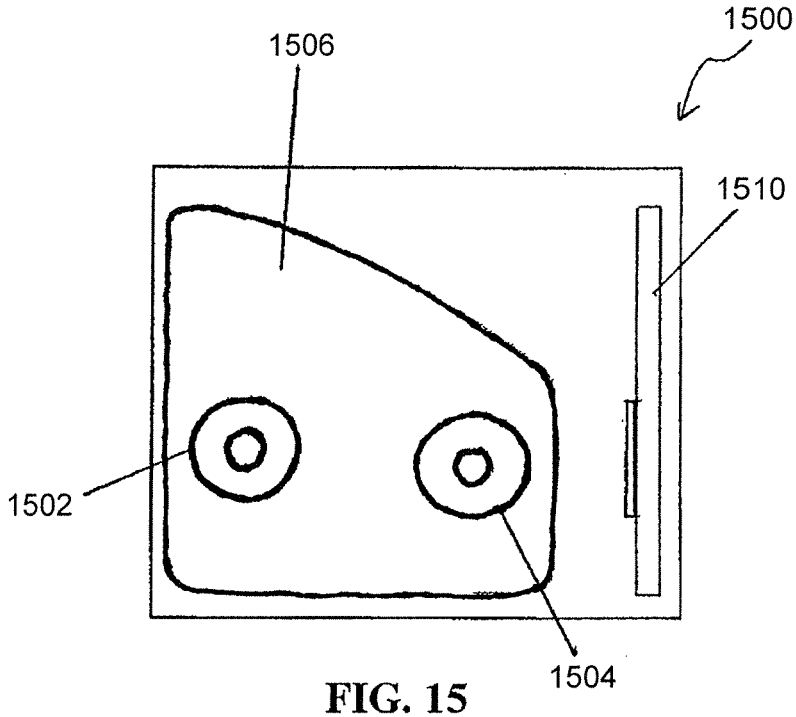
FIG. 15 illustrates a rear side view of a striking plate according to another embodiment.

FIG. 15 illustrates another embodiment of a striking plate 1500. The striking plate 1500 includes a first boss 1502, a second boss 1504, a back surface 1506, and a perimeter wall 1510. The bosses 1502 and 1504 directly engage with the back support surface of the main body and acts as the primary load bearing interface, and the back surface 1506 typically includes a gasket assembly (not shown). When assembled, the back surface 1506 compresses the gasket assembly to a particular compression, such as a compression greater than 0% but less than 100%. The compressed gasket assembly may ensure a flush striking plate and/or may absorb forces during impact. In certain embodiments, the second boss 1504 may be a different width and/or height than the first boss 1502.

In some embodiments, the face plate is one size and can fit any club within the set of clubs ranging from a 48° loft to a 64° loft. This provides the ability to swap different faces into different clubs having a different loft.

Figure 16:
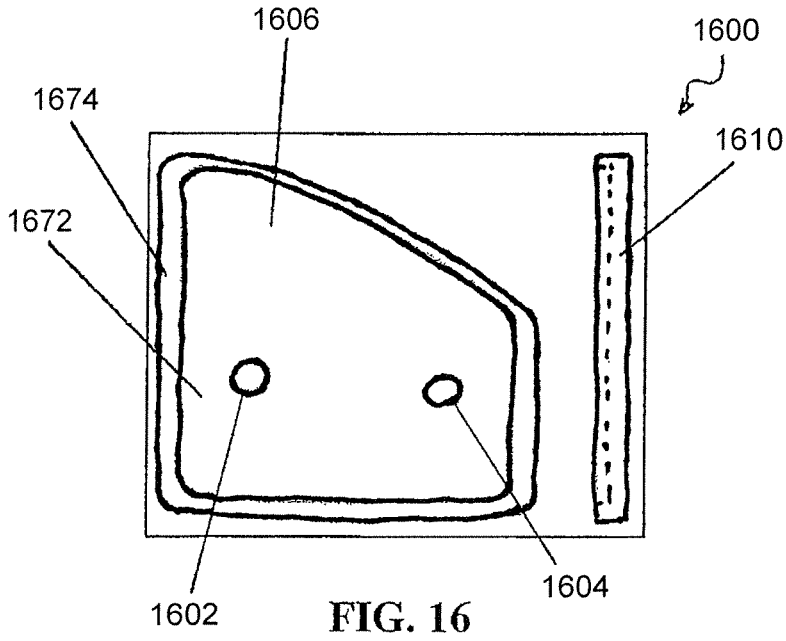
FIG. 16 illustrates a rear side view of a striking plate according to another embodiment.

FIG. 16 illustrates another embodiment of a striking plate 1600. The striking plate 1600 includes a first boss 1602, a second boss 1604, a back surface 1606, a first rear surface region 1672, a second rear surface region 1674, and a perimeter wall 1610. The first rear surface region 1672 is recessed with respect to first rear surface region 1674, such that the second rear surface region 1674 directly engages with the back support surface of the main body and acts as the primary load bearing interface. First rear surface region 1672 typically includes a gasket assembly (not shown). When assembled, the first rear surface region 1672 compresses the gasket assembly to a particular compression, such as a compression greater than 0% but less than 100%. The compressed gasket assembly may ensure a flush striking plate and/or may absorb forces during impact.

In some embodiments, the face plate is one size and can fit any club within the set of clubs ranging from a 48° loft to a 64° loft. This provides the ability to swap different faces into different clubs having a different loft.

At least one advantage of the embodiments described above is that a user can easily remove and insert a replaceable face in a replaceable face wedge without the potential for insert jamming or having the fastening members come loose during use.

Another advantage of the embodiments described is that a minimum amount of thread engagement is made possible in each boss (with different boss heights) while maintaining certain performance features such as durability and the reduction of friction during a swing.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. An iron-type golf club head comprising:

a main body including a heel portion, a sole portion, a toe portion, a top-line portion, a front portion, and a rear portion, the main body having a recessed region including a relief region in the front portion;

a replaceable striking plate configured to be inserted into the recessed region and the relief region, the replaceable striking plate including a front surface defining a face plane, a rear surface defining a first rear surface region and a second rear surface region, a topline edge, and a bottom edge;

at least one opening located on the rear surface of the replaceable striking plate, each such at least one opening being located nearer to a midline between the topline edge and bottom edge of the replaceable striking plate than to either the topline edge or the bottom edge;

at least one through-hole opening located in the rear portion of the main body, the at least one through-hole opening being configured to receive a fastener in the rear portion, the fastener configured to engage the at least one opening located on the rear surface of the replaceable striking plate to retain the replaceable striking plate on the front portion of the main body and within the recessed region and relief region; and wherein the second rear surface region engages with the recessed region of the main body, and wherein the rear surface of the replaceable striking plate in an area surrounding the at least one opening is spaced apart from the aligned rear portion of the main body in an area surrounding the at least one through-hole opening.

2. The iron-type golf club head of claim 1, wherein the rear surface of the replaceable striking plate includes two openings.

3. The iron-type golf club head of claim 1, wherein the relief region is located around a 360° perimeter of the front portion of the main body within a plane parallel to the face plane.

4. The iron-type golf club head of claim 3, wherein the at least one opening is defined in an end of at least one projecting threaded boss.

5. The iron-type golf club head of claim 4, wherein the recessed region edge substantially forms an O-shape.

6. The iron-type golf club head of claim 4, wherein the at least one threaded boss is configured to be inserted within at least one counter bore located in the recessed region, and wherein the end of the boss is spaced from a base of the counter bore.

7. The iron-type golf club head of claim 4, wherein a washer is engaged with the fastener, the washer being located within a counter bore of the main body and being engaged with an end surface of the at least one threaded boss.

8. The iron-type golf club head of claim 4, wherein the at least one threaded boss includes two threaded bosses.

9. The iron-type golf club head of claim 8, wherein the two threaded bosses are a substantially different height with respect to a striking surface of the replaceable striking plate.

10. The iron-type golf club head of claim 9, wherein a fastener is inserted into each of the two threaded bosses, the two threaded bosses being configured to allow the fastener to engage with at least two threads when fully engaged.

11. The iron-type golf club head of claim 1, wherein the recessed region includes a back support surface and a ledge surface, the ledge surface being located between the back support surface and the striking face of the main body in a front to back direction perpendicular to a face plane.

12. The iron-type golf club head of claim 11, wherein the ledge surface is located around a 360° perimeter of the back support surface within a plane parallel to the face plane.

13. The iron-type golf club head of claim 1, wherein at least one indicia is located on the rear surface of the replaceable striking plate and at least one opening is located in the rear portion of the main body and positioned to allow the at least one indicia to be visible through the at least one opening after the replaceable striking plate is attached to the front portion of the main body.

14. An iron-type golf club head comprising:

a main body including a heel portion, a sole portion, a toe portion, a top-line portion, a front portion, and a rear portion;

a replaceable striking plate located on the front portion of the main body, the replaceable striking plate including a front surface defining a face plane and a rear surface defining a first rear surface region, a second rear surface region, a topline edge, and a bottom edge, and including at least one opening located on the rear surface of the replaceable striking plate, each such at least one opening being located nearer to a midline between the topline edge and bottom edge of the replaceable striking plate than to either the topline edge or the bottom edge, wherein the front portion of the main body includes a recessed region including a relief region, the relief region substantially forming an O-shape;

wherein the second rear surface region directly engages with the recessed region of the main body except in an area surrounding the at least one opening.

15. The iron-type golf club head of claim 14, wherein the relief region is located around a 360° perimeter of the recessed region.

16. The iron-type golf club head of claim 14, wherein the recessed region includes a back support surface and a ledge surface, the ledge surface being located between the back support surface and the striking face of the main body in a front to back direction that is perpendicular to the face plane.

17. An iron-type golf club head comprising:

a main body including a heel portion, a sole portion, a toe portion, a top-line portion, a front portion, and a rear portion;

a replaceable striking plate located on the front portion of the main body, the replaceable striking plate including a front surface defining a face plane, a rear surface defining a first rear surface region and a second rear surface region, a topline edge, and a bottom edge;

at least one opening located on the rear surface of the replaceable striking plate, each such at least one opening being located nearer to a midline between the topline edge and bottom edge of the replaceable striking plate than to either the topline edge or the bottom edge;

at least one indicia located on the rear surface of the replaceable striking plate;

at least one opening located in the rear portion of the main body, wherein the indicia located on the rear surface of the replaceable striking plate is visible through the at least one opening after the replaceable striking plate is attached to the front portion of the main body;

wherein the second rear surface region directly engages with the front portion of the main body except in an area surrounding the at least one opening.

18. The iron-type golf club head of claim 17, wherein the front portion of the main body includes a recessed region including a relief region, the relief region substantially forming an O-shape.

* * * * *